US011519191B2

(12) United States Patent
Bauza

(10) Patent No.: US 11,519,191 B2
(45) Date of Patent: Dec. 6, 2022

(54) WALLBOARD REMOVAL TOOL

(71) Applicant: Aaron Bauza, Belleville, IL (US)

(72) Inventor: Aaron Bauza, Belleville, IL (US)

( * ) Notice: Subject to any disclaimer, the term of this patent is extended or adjusted under 35 U.S.C. 154(b) by 348 days.

(21) Appl. No.: 15/756,715

(22) PCT Filed: Sep. 1, 2016

(86) PCT No.: PCT/US2016/049916
§ 371 (c)(1),
(2) Date: Mar. 1, 2018

(87) PCT Pub. No.: WO2017/040791
PCT Pub. Date: Mar. 9, 2017

(65) Prior Publication Data

US 2019/0063089 A1 Feb. 28, 2019

Related U.S. Application Data

(60) Provisional application No. 62/212,764, filed on Sep. 1, 2015.

(51) Int. Cl.
*E04G 23/08* (2006.01)
*E02D 37/00* (2006.01)
*B66F 15/00* (2006.01)

(52) U.S. Cl.
CPC ..... *E04G 23/08* (2013.01); *B66F 15/00* (2013.01); *E02D 37/00* (2013.01)

(58) Field of Classification Search
CPC ..... Y10T 29/53683; Y10T 29/53796; Y10T 29/53857; Y10T 29/53861; Y10T 29/53865; Y10T 29/5387; Y10T 29/53874; Y10T 29/53878; Y10T 29/53887; Y10T 29/53891; Y10T 29/53896; Y10T 29/53657; Y10T 29/53987; B25B 27/04; B25B 27/06; B25B 27/28; F16B 13/0833; E04G 23/08
See application file for complete search history.

(56) References Cited

U.S. PATENT DOCUMENTS 1,650,964 A * 11/1927 Schmitt ..... B25B 27/062 29/262
1,962,289 A * 6/1934 Waldon ..... B25B 27/062 29/265
2,098,134 A * 11/1937 Cook ..... B25B 27/062 29/265
9,453,524 B2 * 9/2016 Sisto ..... F16B 13/0808
(Continued)

*Primary Examiner* — Lee D Wilson
*Assistant Examiner* — Sidney D Hohl
(74) *Attorney, Agent, or Firm* — The Small Patent Law Group LLC; Jay J. Hoette

(57) ABSTRACT

A wallboard removal tool includes a shaft extending between an inner end and an outer end. An outer wallboard support is movably coupled to the shaft. An inner wallboard support is movably coupled to the shaft. The inner wallboard support is provided at the inner end. The inner wallboard support is configured to engage an interior surface of a wallboard and the outer wallboard support is configured to engage an exterior surface of the wallboard to capture the wallboard therebetween. The wallboard removal tool is shaken to free the wallboard from fasteners holding the wallboard to studs of the wall.

44 Claims, 5 Drawing Sheets

(56) References Cited

U.S. PATENT DOCUMENTS

2012/0318109 A1* 12/2012 Parkin ..... A43C 11/008
81/485
2013/0221593 A1* 8/2013 Melchior ..... B25B 5/10
269/107

* cited by examiner

WALLBOARD REMOVAL TOOL

CROSS REFERENCE TO RELATED APPLICATIONS

This application is a National Stage Application of PCT/US2016/049916, filed Sep. 01, 2016 titled WALLBOARD REMOVAL TOOL, which claims the benefit of U.S. Provisional Application No. 62/212,764 filed Sep. 1, 2015 titled WALLBOARD REMOVAL TOOL, the subject matter of which is herein incorporated by reference in its entirety.

BACKGROUND OF THE INVENTION

The subject matter herein relates generally to a wallboard removal tool.

Wallboard is typically removed by punching a hole in the wallboard, such as with a hammer, and then physically ripping pieces of the wallboard off of the wall. As the pieces are ripped off of the wall, the gypsum plaster breaks, leaving dust and debris on the floor, inside the wall and elsewhere. As the pieces are removed from the home or building, the dust and debris tends to disperse throughout the home or building and may even enter the heating and cooling system, such as through the cold air return of the home or building. Wallboard removal is very messy and can even create a mess in spaces of the home or building that are not undergoing remodeling. Additionally, the wallboard is typically broken into many small pieces that need to be individually handled, increasing clean-up time. Moreover, as the contractor hammers through the wallboard to create the holes and break apart the wallboard, the wallboard on the opposite side of the wall may be damaged and/or other items hanging from the wall may be knocked off of the wall by the impact.

A need remains for a wallboard removal tool that overcomes these and other problems associated with removing wallboard.

BRIEF DESCRIPTION OF THE INVENTION

In one embodiment, a wallboard removal tool is provided including a shaft extending between an inner end and an outer end. An outer wallboard support is movably coupled to the shaft. An inner wallboard support is movably coupled to the shaft. The inner wallboard support is provided at the inner end. The inner wallboard support is configured to engage an interior surface of a wallboard and the outer wallboard support is configured to engage an exterior surface of the wallboard to capture the wallboard therebetween. The wallboard removal tool is shaken to free the wallboard from fasteners holding the wallboard to studs of the wall.

In another embodiment, a wallboard removal tool is provided including a shaft extending between an inner end and an outer end, an outer wallboard support and an inner wallboard support. The outer wallboard support has a sleeve and a support plate extending radially outward from the sleeve. The sleeve is slidably coupled to the shaft. The inner wallboard support has a plurality of support arms rotatably coupled to the shaft at the inner end. The support arms are movable between closed positions and opened positions. The support arms are folded close to the shaft in the closed positions. The support arms are splayed outward away from the shaft in the opened positions. The inner end and the inner wallboard support are configured to pass through an opening in a wallboard when the support arms are in the closed positions and the support arms are configured to be moved to the opened positions behind the wallboard to engage an interior surface of the wallboard. The outer wallboard support is advanced toward the inner wallboard support to engage an exterior surface of the wallboard to capture the wallboard therebetween. The wallboard removal tool is shaken to free the wallboard from fasteners holding the wallboard to studs of the wall.

DETAILED DESCRIPTION OF THE INVENTION

Figure 1:
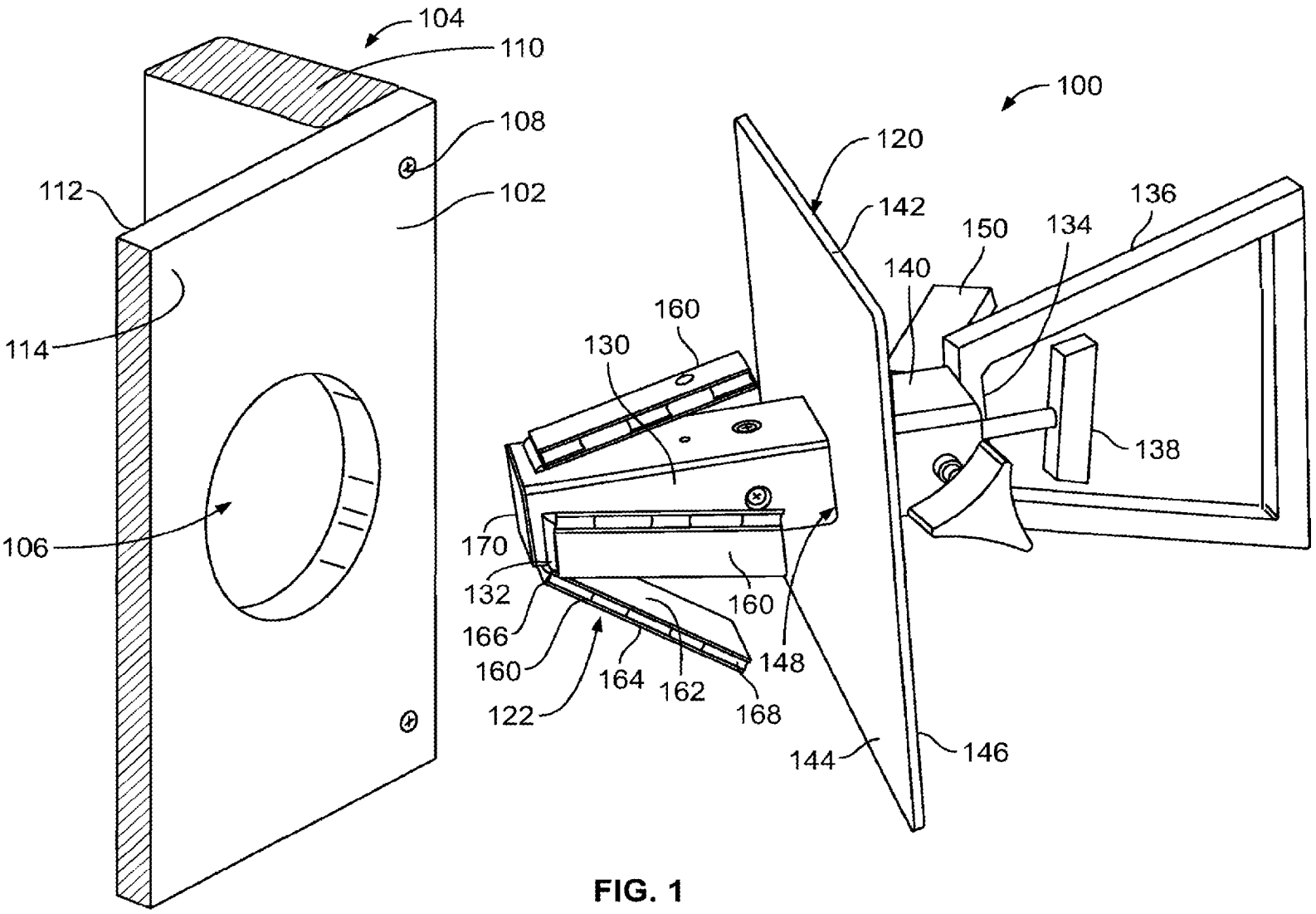
FIG. 1 is a perspective view of a wallboard removal tool formed in accordance with an exemplary embodiment.

FIG. 1 is a perspective view of a wallboard removal tool 100 formed in accordance with an exemplary embodiment. The wallboard removal tool 100 is used to remove a wallboard 102 from a wall 104. For example, the wallboard removal tool 100 may be inserted through an opening 106 in the wallboard 102. The wallboard removal tool 100 may be clamped or otherwise secured to the wallboard 102 and shaken to free the wallboard 102 from fasteners 108 holding the wallboard 102 to studs 110 of the wall 104.

The wallboard removal tool 100 includes an outer wallboard support 120 and an inner wallboard support 122. The wallboard removal tool 100 captures the wallboard 102 between the outer and inner wallboard supports 120, 122. The inner wallboard support 122 is configured to be loaded through the opening 106 to engage an interior surface 112 of the wallboard 102 while the outer wallboard support 120 engages an exterior surface 114 of the wallboard 102. The wallboard 102 may be clamped or sandwiched between the outer and inner wallboard supports 120, 122. Optionally, the outer wallboard support 120 may be locked in position relative to the inner wallboard support 122, such as at a predetermined distance or spacing therebetween to accommodate certain standard sized wall boards 102. For example, the outer wallboard support 120 may be positioned approximately half inch, three eighths inch, five eighths inch or at other standard distances to accommodate standard thickness wall boards. The spacing between the outer and inner wallboard supports 120, 122 may be variable to accommodate non-standard thickness walls, such as walls having a plaster veneer.

The wallboard removal tool 100 includes a shaft 130 extending between an inner end 132 and an outer end 134. The shaft 130 may have any shape. In the illustrated embodiment, the shaft 130 has a rectangular cross-section having four sides; however, the shaft 130 may have other shapes in alternative embodiments. For example, the shaft 130 may be cylindrical.

The wallboard removal tool 100 includes a handle 136 at or near the outer end 134. The handle 136 may be fixed at the outer end 134. Alternatively, the shaft 130 may be movable relative to the handle 136 and/or the handle 136 may be movable relative to the shaft 130. The handle 136 may be gripped by the user to shake the wallboard removal tool 100 to remove the wallboard 102 from the wall 104. The handle 136 may be economical. The handle 136 may be oversized to allow a user wearing a glove to grip the handle 136. The handle 136 may have any size or shape. The handle 136 may be closed or may be open.

The wallboard removal tool 100 includes an actuator 138. The actuator 138 may be at or near the handle 136. The actuator 138 may be at or near the outer end 134. The actuator 138 is operably coupled to the inner wallboard support 122 to actuate the inner wallboard support 122. For example, the actuator 138 may be used to open the inner wallboard support 122 and/or close the inner wallboard support 122. The actuator 138 may be actuated by pulling the actuator 138, pushing the actuator 138, rotating the actuator 138 or by other movements. Optionally, the actuator 138 may pass at least partially through the shaft 130 toward the inner end 132 two operably engage the inner wallboard support 122.

The outer wallboard support 120 is coupled to the shaft 130. The outer wallboard support 120 and the shaft 130 may be movable relative to each other. For example, the outer wallboard support 120 may be slidable along the shaft 130. Alternatively, the shaft 130 may be slidable relative to the outer wallboard support 120. In other various embodiments, the outer wallboard support 120 and the shaft 130 may be rotatable relative to each other in addition to or in lieu of being slidable.

The outer wallboard support 120 includes a sleeve 140 and a support plate 142 extending radially outward from the sleeve 140. The support plate 142 may be provided at a front end of the sleeve 140. In the illustrated embodiment, the sleeve 140 is slidably coupled to the shaft 130. For example, the shaft 130 may pass through an interior of the sleeve 140. The support plate 142 has a front 144 and a rear 146. The front 144 faces the exterior surface 114 of the wallboard 102 and may press against the exterior surface 114 of the wallboard 102 when the wallboard removal tool 100 is coupled to the wallboard 102. The front 144 may be planar. In an exemplary embodiment, the front 144 has a large surface area. For example, in the illustrated embodiment, the support plate 142 has a height and a width of approximately 8"×8"; however, the support plate 142 may have other heights and/or widths in alternative embodiments. Optionally, the sleeve 140 extends rearward from the rear 146. The support plate 142 includes an opening 148 therethrough. The shaft 130 may pass through the opening 148. The actuator 138 may pass through the opening 148.

In an exemplary embodiment, the outer wallboard support 120 includes a locking feature 150 to lock a position of the outer wallboard support 120 with respect to the shaft 130. Optionally, the locking feature 150 may be locked to the shaft 130 at a predetermined location, which may correspond to a thickness of the wallboard 102 to ensure that the wallboard 102 is tightly held between the outer wallboard support 120 and the inner wallboard support 122. Optionally, the locking feature 150 may be locked at multiple predetermined positions relative to the shaft 130 to accommodate different standard wallboard thicknesses, such as ⅜", ½" and ⅝" wallboard. In the illustrated embodiment, the locking feature 150 is a latch rotatably coupled to the sleeve 140. A portion of the locking feature 150 may be rotated through the sleeve 140 to engage the shaft 130. For example, a portion of the locking feature 150 may pass through an opening in the sleeve 140 and through an opening in the shaft 130 to lock the relative position between the outer wallboard support 120 and the shaft 130. The locking feature 150 may use a cam action to close or cinch the outer wallboard support 122 against the wallboard 102. Other types of locking features may be used in alternative embodiments. For example, the locking feature 150 may be a threaded fastener. The locking feature 150 may be a spring release pin. The locking feature 150 may be a threaded engagement between the shaft 130 and the sleeve 140. The locking feature 150 may be a ratchet member. The locking feature may be a gear, such as a worm gear to control the relative position between the outer wallboard support 120 and the shaft 130. Other types of locking features may be used in alternative embodiments.

The inner wallboard support 122 is collapsible and expandable to allow the inner wallboard support 122 to pass through the opening 106 behind the wallboard 102 to engage the interior surface 112 of the wallboard 102. For example, the inner wallboard support 122 may be collapsed against the shaft 130 such that the inner end 132 and the inner wallboard support 122 may pass through the opening 106. The inner wallboard support 122 may then be expanded behind the wallboard 102 and pulled against the interior surface 112 to capture the wallboard 102 between the outer wallboard support 120, such as the support plate 142, and the inner wallboard support 122.

In an exemplary embodiment, the inner wallboard support 120 includes a plurality of support arms 160 coupled to the shaft 130 at or near the inner end 132. In the illustrated embodiment, the inner wallboard support 120 includes four support arms 160 extending from each of the corresponding sides of the shaft 130; however, the inner wallboard support 122 may include any number of support arms 160. Optionally, the support arms 160 may be oriented at 90° with respect to each other; however, the support arms 160 may be at any angular orientation relative to each other in alternative embodiments.

In an exemplary embodiment, the support arms 160 are rotatably coupled to the shaft 130 and may be rotated between closed positions and opened positions. For example, the support arms 160 may be collapsed are folded inward against the shaft 130 to the closed positions and may be expanded outward by rotating the support arms 160 outward to the opened positions. The support arms 160 are rotated to opened positions to increase the surface area of the inner wallboard support 122.

Each support arm 160 includes an interior side 162 and an exterior side 164 extending between an attachment end 166 and a free end 168. The interior side 162 is generally parallel to and faces the shaft 130 in the closed position. The support arm 160 may be splayed outward away from the shaft 130 to the opened position. In the opened position, the interior side 162 may be generally perpendicular to the shaft 130 and face the interior surface 112 of the wallboard 102.

The support arm 160 may be elongated between the attachment end 166 and the free end 168. The length of the support arm 160 may correspond to a standard wall thickness. For example, the length may be slightly less than a width of the stud (e.g., approximately 3" to fit in the cavity defined by a 2×4 stud). The length may be longer if the wallboard removal tool 100 is used in a 2×6 wall. The length of the support arm 160 corresponds to the surface area or circumference of the inner wallboard support 122 in the opened position. In other various embodiments, the support arms 160 may be foldable or collapsible on themselves such that in the closed position, the support arms 160 may be folded or shortened to fit in the wall cavity and then when the inner wallboard support 122 is opened, the support arms 160 may be unfolded to increase the length thereof, further increasing the surface area or circumference of the inner wallboard support 122. In other various embodiments, the support arms 160 may have extensions (e.g., extending outward from the central axis of the support arms 160) that increase the surface area of the support arms 160 available for engagement with the wallboard 102.

The wallboard removal tool 100 includes a cover 170 at the inner end 132. The cover 170 covers an interior cavity 172 of the shaft 130. Optionally, the attachment ends 166 of the support arms 160 may extend into the cavity 172. The cover 170 may cover the attachment ends 166 of the support arms 160. The cover 170 may cover the actuator 138 inside the cavity 172.

The wallboard removal tool 100, or portions thereof, may be made from metal material. The wallboard removal tool 100, or portions thereof, may be made from plastic material.

Figure 2:
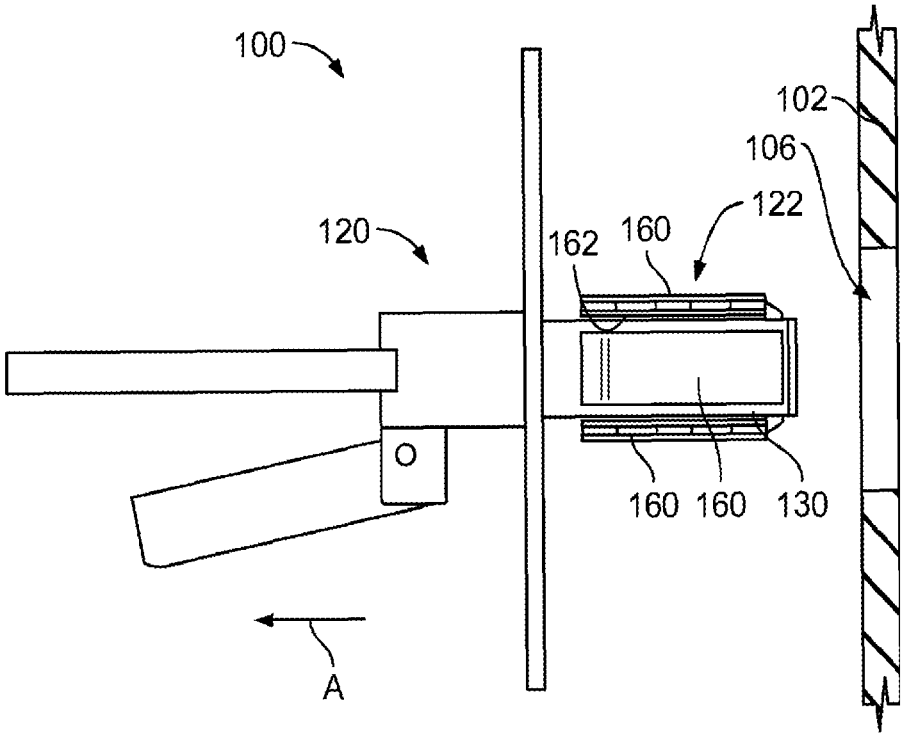
FIG. 2 is a side view of the wallboard removal tool poised for loading through an opening in wallboard.

FIG. 2 is a side view of the wallboard removal tool 100 poised for loading through the opening 106 in the wallboard 102 (shown in cross-section). The inner wallboard support 122 may be folded inward such that the support arms 160 are folded close to the shaft 130 such that the support arms 160 may pass through the opening 106 in the wallboard 102. Optionally, the interior sides 162 may abut against the exterior of the shaft 130. The outer wallboard support 120 is pulled rearward relative to the shaft 130 (in the direction of arrow A) to provide clearance in space for the support arms 160 to be folded closed against the shaft 130.

Figure 3:
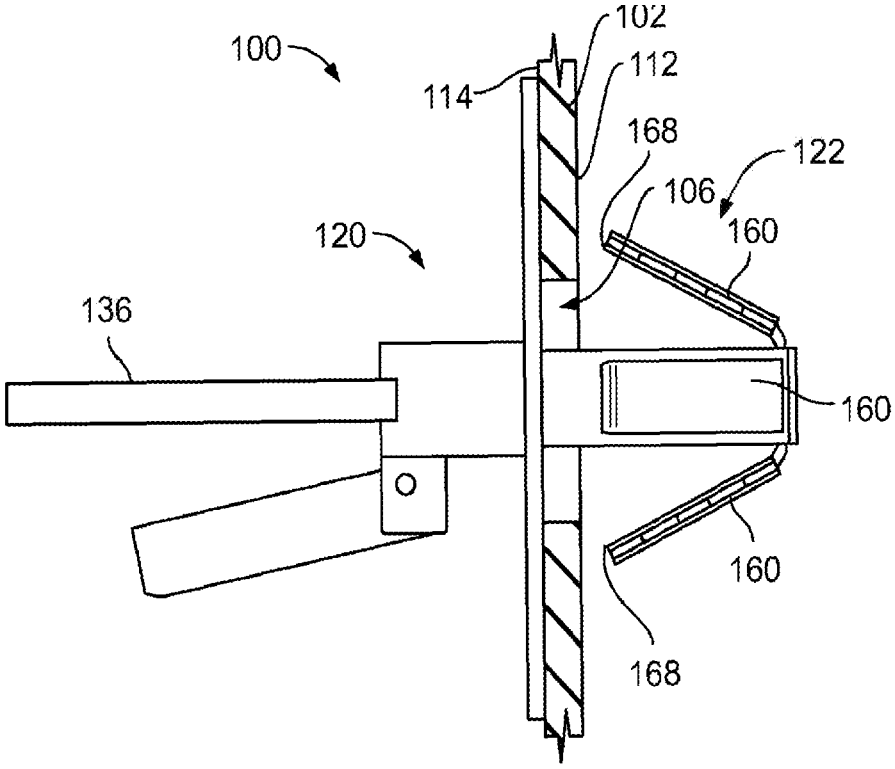
FIG. 3 is a side view of the wallboard removal tool attached to the wallboard showing an inner wallboard support in a partially opened position.

FIG. 3 is a side view of the wallboard removal tool 100 attached to the wallboard 102 showing the inner wallboard support 122 in a partially opened position. Once the support arms 160 pass through the opening 106 beyond the interior surface 112 the support arms 160 may be opened. Optionally, the support arms 160 may be spring biased to an opened position. Optionally, the support arms 160 may be directly spring biased or alternatively the actuator 138 (shown in FIG. 1) may be spring biased to partially open the support arms 160. The support arms 160 may be opened to a holding position wherein the support arms 160 are splayed foreign of open that the inner wallboard support 122 is unable to be removed from behind the wallboard 102 through the opening 106. For example, the free ends 168 of the support arms 160 have a larger circumference than the opening 106 such that the wallboard removal tool 100 is unable to be removed from the wallboard 102. As the wallboard removal tool 100 is pulled away from the wallboard 102, the free ends 168 of the support arms 160 engage the interior surface 112 of the wallboard 102. Further pulling of the wallboard removal tool 100 causes the support arms 160 to open further to a fully opened position. Such opening of the inner wallboard support 122 may occur with the outer wallboard support 120 pulled rearward away from the wallboard 102. Alternatively, the outer wallboard support 120 may be pushed forward against the exterior surface 114 of the wallboard 102 while the handle 136 is pulled rearward away from the wallboard 102.

Figure 4:
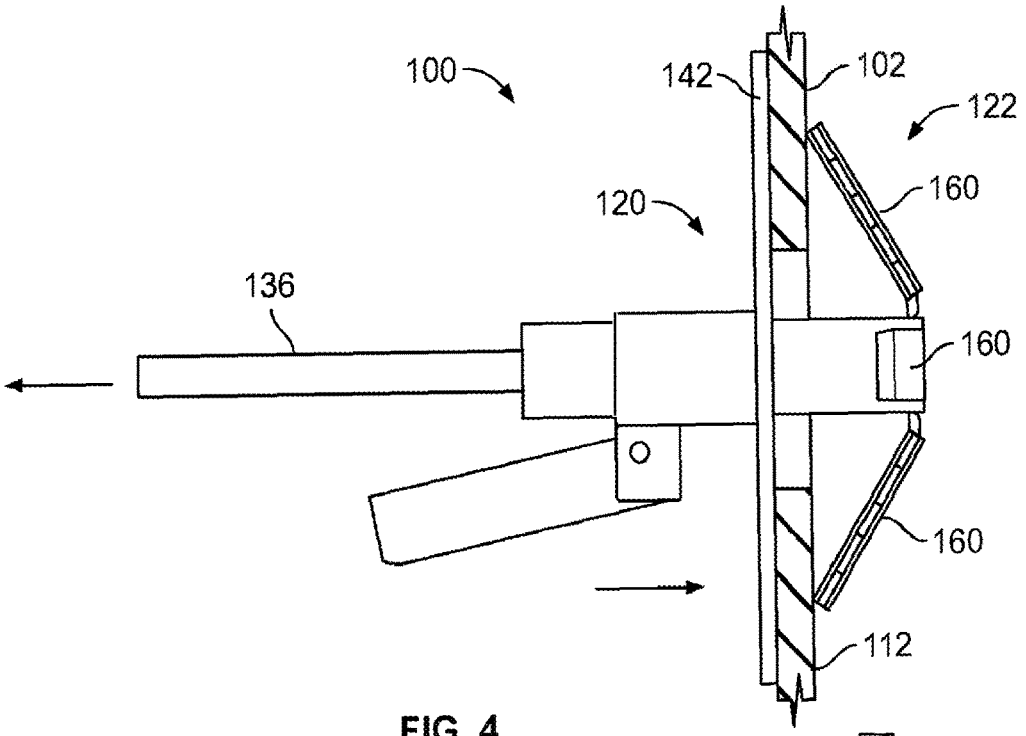
FIG. 4 is a side view of the wallboard removal tool attached to the wallboard showing the inner wallboard support in a partially opened position and showing an outer wallboard support advanced toward the wallboard.

FIG. 4 is a side view of the wallboard removal tool 100 attached to the wallboard 102 showing the inner wallboard support 122 in a partially opened position and showing the outer wallboard support 120 advanced toward the wallboard 102. As the handle 136 is pulled away from the wallboard 102 and the support plate 142 is pushed toward the wallboard 102, the wallboard 102 begins to be captured between the outer wallboard support 120 and the inner wallboard support 122. The support arms 160 flare open against the interior surface 112.

Figure 5:
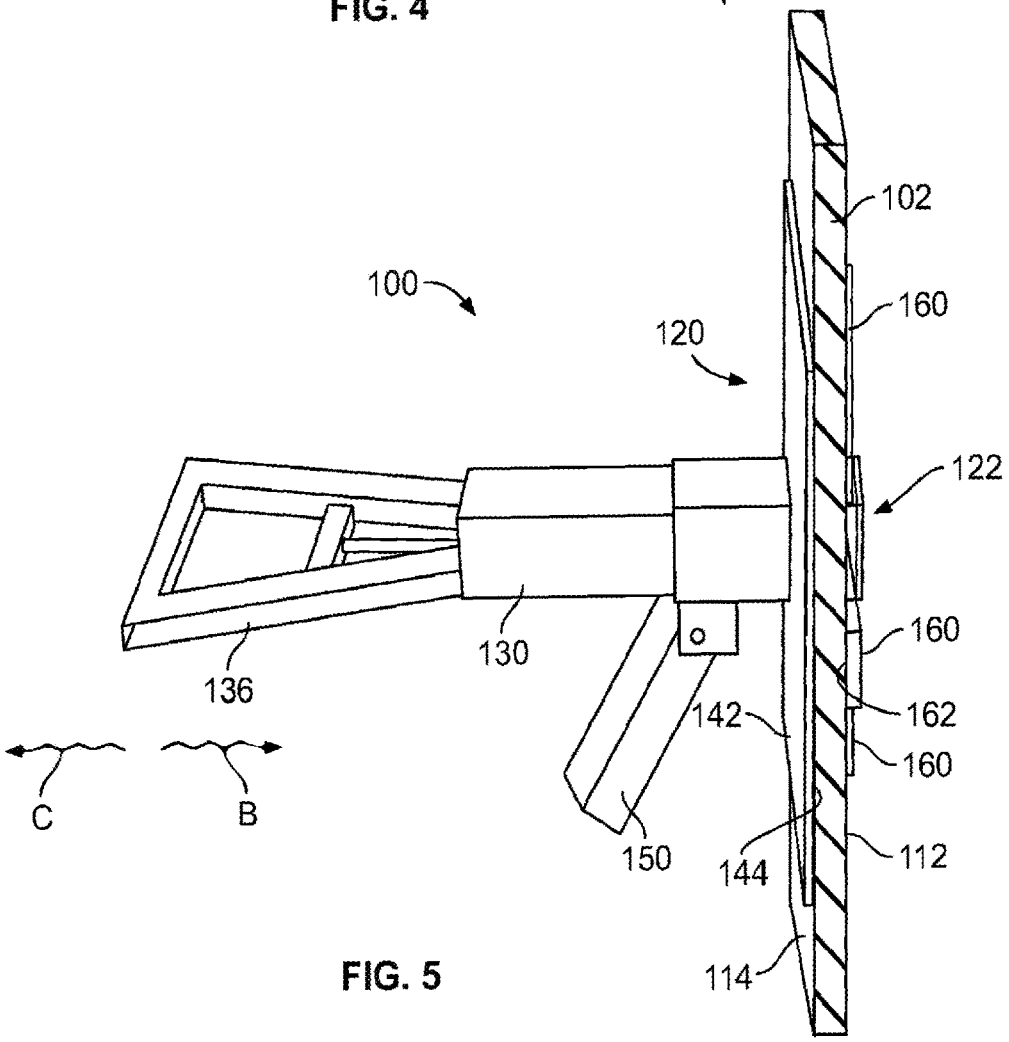
FIG. 5 is a side view of the wallboard removal tool attached to the wallboard showing the inner wallboard support in the opened position and showing the outer wallboard support in an advanced position.

FIG. 5 is a side view of the wallboard removal tool 100 attached to the wallboard 102 showing the inner wallboard support 122 in the opened position and showing the outer wallboard support 120 in an advanced position. In the advanced position, the outer wallboard support 120 is pushed forward along the shaft 130 until the wallboard 102 is captured between the outer wallboard support 120 and the inner wallboard support 122.

The locking feature 150 is able to be locked to hold the outer wallboard support 120 along the shaft 130. When the locking feature 150 is locked, the outer wallboard support 120 is fixed relative to the inner wallboard support 122 with the wallboard 102 captured therebetween. For example, the front 144 of the support plate 142 engages the exterior surface 114 of the wallboard 102 and the interior sides 162 of the support arms 160 engage the interior surface 112 of the wallboard 102. The locking feature 150 may be locked at a position that corresponds to the standard thickness of the wallboard 102.

During removal of the wallboard 102, after the wallboard removal tool 100 is attached to the wallboard 102, the wallboard removal tool 100 may be shaken to loosen the wallboard 102 from the fasteners 108 holding the wallboard 102 onto the studs 110. For example, the handle 136 may be repeatedly pushed (arrow B) and pulled (arrow C) toward and away from the wall 104. Optionally, the wallboard removal tool 100 may be used to loosen a large section of the wallboard 102 from the studs 110, such as approximately half of the wallboard 102. The wallboard removal tool 100 may be removed from the wallboard 102 and moved to another location of the wallboard 102 to loosen the remaining section of the wallboard 102. In an exemplary embodiment, a full sheet of wallboard 102 may be removed by attaching the wallboard removal tool 100 at two different locations. Removal of the full sheet of wallboard 102 eliminates breaking the wallboard 102 into pieces and creating a mess of dust and debris.

Figure 6:
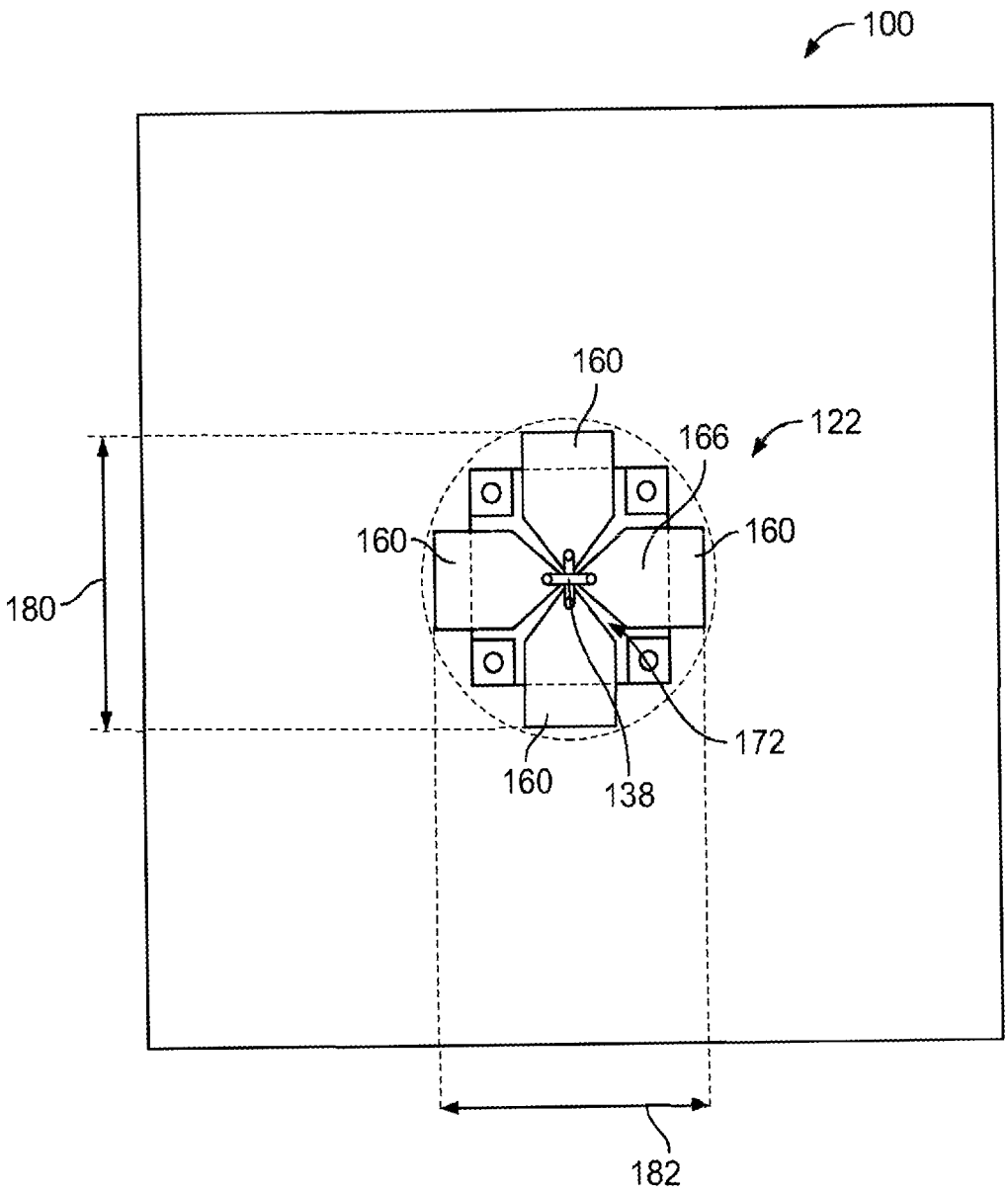
FIG. 6 is a front view of the wallboard removal tool showing the inner wallboard support in a closed position.

FIG. 6 is a front view of the wallboard removal tool 100 showing the inner wallboard support 122 in a closed position. The cover 170 (shown in FIG. 1) is removed to illustrate the support arms 160. The attachment ends 166 of the support arms 160 extend into the cavity 172. Optionally, the attachment ends 166 may be approximately triangular-shaped to allow each of the attachment ends 166 to fit within the cavity 172. The actuator 138 is attached to each of the attachment ends 166. As the actuator 138 is moved backwards and forward the attachment ends 166 may be moved into and out of the cavity 172 to close and open the support arms 160. The attachment ends 166 may have other shapes in alternative embodiments. The attachment ends 166 may be attached to the actuator 138 by any means or processes. In the illustrated embodiment, the actuator 138 passes through openings in the attachment end 166 to connect the actuator 138 to the support arms 160. For example, the actuator 138 may include pins or wire extending through the openings. In other various embodiments, the attachment ends 166 include pins or tabs extending outward therefrom that are received in grooves or slots formed in the shaft 130. The grooves may define a rail that controls movement of the support arms 160. The grooves may at least partially extend along a curved path to control the pivoting or movement of the support arms 160.

In the closed position, the support arms 160 have a first height 180 and a first width 182. The first height 180 and first width 182 define a surface area or circumference of the inner wallboard support 122. Such circumference is able to pass through the opening 106 (shown in FIG. 1).

Figure 7:
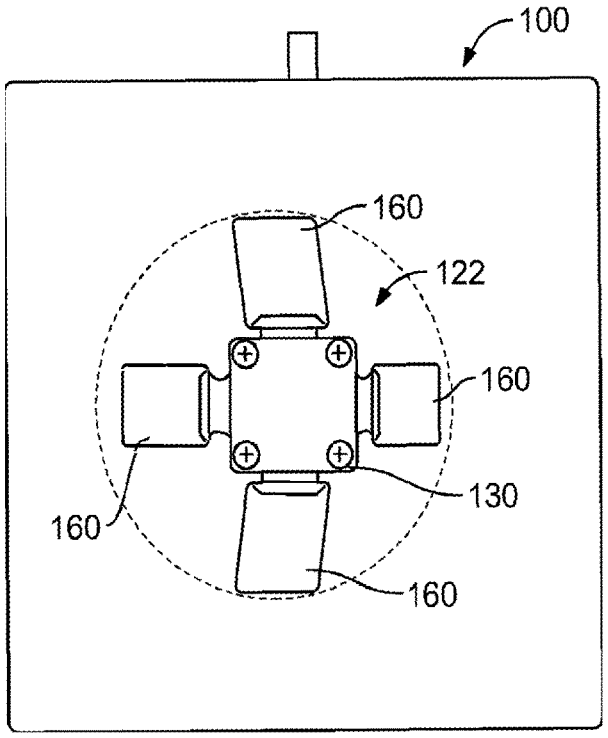
FIG. 7 is a front view of the wallboard removal tool showing the inner wallboard support in a partially opened position.

FIG. 7 is a front view of the wallboard removal tool 100 showing the inner wallboard support 122 in a partially opened position. The support arms 160 are splayed partially open and are angled relative to the shaft 130. The inner wallboard support 122 has a larger circumference (e.g., height and width) than in the closed state.

Figure 8:
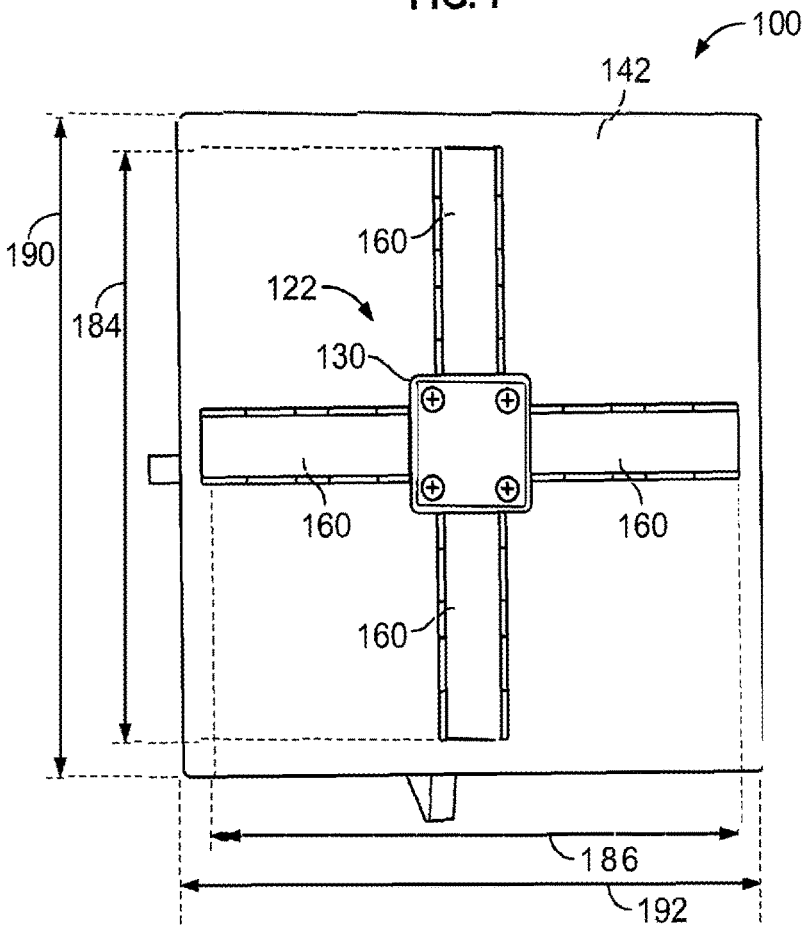
FIG. 8 is a front view of the wallboard removal tool showing the inner wallboard support in a fully opened position.

FIG. 8 is a front view of the wallboard removal tool 100 showing the inner wallboard support 122 in a fully opened position. The support arms 160 extend outward from the shaft 130. Optionally, the support arms 160 may be oriented at approximately 90° with respect to each other. Other angular orientations are possible in alternative embodiments.

In the opened position, the inner wallboard support 122 has a second height 184 and a second width 186 larger than the first height 180 and a second height 182 (both shown in FIG. 6). In the illustrated embodiment, the second height 184 is at least three times the first height 180 and a second width 186 is at least three times the first width 182. The second height 184 and the second width 186 define a surface area or circumference of the inner wallboard support 122 in the opened position. The surface area in the opened position may be significantly greater than the surface area in the closed position (FIG. 6). Optionally, the surface area in the opened position may be approximately equal to the surface area of the support plate 142. For example, the support plate 142 may have a third height 190 in a third width 192 approximately equal to the second height 184 and the second width 186, respectively.

In accordance with various embodiments herein, a wallboard removal tool is provided including a shaft extending between an inner end and an outer end. An outer wallboard support is movably coupled to the shaft. An inner wallboard support is movably coupled to the shaft. The inner wallboard support is provided at the inner end. The inner wallboard support is configured to engage an interior surface of a wallboard and the outer wallboard support is configured to engage an exterior surface of the wallboard to capture the wallboard therebetween. The wallboard removal tool is shaken to free the wallboard from fasteners holding the wallboard to studs of the wall.

Optionally, the outer wallboard support may include a sleeve and a support plate extending outward from the sleeve. The sleeve may be slidably coupled to the shaft. Optionally, the outer wallboard support may be slidably coupled to the shaft and movable between an advanced position and a retracted position. The outer wallboard support may engage the wallboard in the advanced position.

Optionally, the inner wallboard support may be rotatably coupled to the shaft and rotated between a closed position and an opened position. The inner wallboard support may have a larger outer circumference in the opened position than the closed position. The inner wallboard support may include a plurality of support arms rotatably coupled to the inner end of the shaft. The support arms may be opened after the inner wallboard support is positioned behind the interior surface of the wallboard. The support arms may lay flat against the shaft in closed positions and may be rotated to opened positions to increase a surface area of the inner wallboard support. The support arms may be elongated between attachment ends and free ends. The support arms may be rotated about the attachment ends to move the free ends away from the shaft. Each support arm may include an interior side and an exterior side extending between an attachment end and a free end. The interior side may be generally parallel to and face the shaft in a closed position. The interior side may be generally perpendicular to the shaft and face the interior surface of the wallboard in an opened position. The shaft may include four sides. The inner wallboard support may include four support arms each associated with and extending from a corresponding side of the shaft. Optionally, the inner wallboard support may be spring biased toward an opened position.

Optionally, the wallboard removal tool may include an actuator coupled to the inner wallboard support. The actuator may cause the inner wallboard support to move from a closed position to an opened position after the inner wallboard support is positioned behind the wallboard. The actuator may extend from the inner end to the outer end and may be coupled to the inner wallboard support at the inner end.

Optionally, the wallboard removal tool may include a handle at the outer end of the shaft. The handle may be shaken to free the wallboard from the fasteners holding the wallboard to the sides of the wall.

Optionally, the wallboard removal tool may include a locking feature to lock a position of the outer wallboard support with respect to the shaft. The locking feature may be positioned to lock the outer wallboard support at approximately half inch from the inner wallboard support to fit half-inch wallboard therebetween.

Optionally, the inner wallboard support may be configured to pass through an opening in the wallboard. The inner wallboard support may be actuated to a partially opened position behind the wallboard such that the inner wallboard support is larger than the opening such that the inner wallboard support is unable to be pulled back through the opening. The shaft may be pulled away from the wallboard to pull the inner wallboard support against the interior surface of the wallboard to force the inner wallboard support to a fully opened position flush against the interior surface of the wallboard.

Optionally, the inner wallboard support may have a first height and a first width in a closed position and the inner wallboard support may have a second height and a second width in an opened position. The second height may be at least three times the first height. The second width may be at least three times the first width. The outer wallboard support may include a support plate having a front surface configured to press against the exterior surface of the wallboard. The support plate may have a third height and a third width approximately equal to the second height and the second width, respectively.

In another embodiment, a wallboard removal tool is provided including a shaft extending between an inner end and an outer end, an outer wallboard support and an inner wallboard support. The outer wallboard support has a sleeve and a support plate extending radially outward from the sleeve. The sleeve is slidably coupled to the shaft. The inner wallboard support has a plurality of support arms rotatably coupled to the shaft at the inner end. The support arms are movable between closed positions and opened positions. The support arms are folded close to the shaft in the closed positions. The support arms are splayed outward away from the shaft in the opened positions. The inner end and the inner wallboard support are configured to pass through an opening in a wallboard when the support arms are in the closed positions and the support arms are configured to be moved to the opened positions behind the wallboard to engage an interior surface of the wallboard. The outer wallboard support is advanced toward the inner wallboard support to engage an exterior surface of the wallboard to capture the wallboard therebetween. The wallboard removal tool is shaken to free the wallboard from fasteners holding the wallboard to studs of the wall.

Optionally, the inner wallboard support may have a larger outer circumference in the opened position than the closed position. The support arms may lay flat against the shaft in the closed positions and may be rotated to the opened positions to increase a surface area of the inner wallboard support. The support arms may be elongated between attachment ends and free ends. The support arms may be rotated about the attachment ends to move the free ends away from the shaft.

Optionally, each support arm may include an interior side and an exterior side extending between an attachment end and a free end. The interior side may be generally parallel to and may face the shaft in the closed position. The interior side may be generally perpendicular to the shaft and may face the interior surface of the wallboard in the opened position.

Optionally, the shaft may include four sides. The inner wallboard support may include four support arms each associated with and extending from a corresponding side of the shaft.

Optionally, the wallboard removal tool may include an actuator coupled to the inner wallboard support causing the inner wallboard support to move from the closed position to the opened position after the inner wallboard support is positioned behind the wallboard. The actuator may extend from the inner end to the outer end and may be coupled to the inner wallboard support at the inner end.

Optionally, the wallboard removal tool may include a handle at the outer end of the shaft. The handle may be shaken to free the wallboard from the fasteners holding the wallboard to the sides of the wall. Optionally, the wallboard removal tool may include a locking feature to lock a position of the outer wallboard support with respect to the shaft. The locking feature may be positioned to lock the outer wallboard support at approximately half-inch from the inner wallboard support to fit half-inch wallboard therebetween.

Optionally, the inner wallboard support may have a first height and a first width in a closed position and the inner wallboard support may have a second height and a second width in an opened position. The second height may be at least three times the first height and the second width may be at least three times the first width. The outer wallboard support may include a support plate having a front surface configured to press against the exterior surface of the wallboard. The support plate may have a third height and a third width approximately equal to the second height and the second width, respectively.

Optionally, the inner wallboard support may be spring biased toward an opened position. The inner wallboard support may be actuated to a partially opened position behind the wallboard such that the inner wallboard support is larger than the opening such that the inner wallboard support is unable to be pulled back through the opening. The shaft may be pulled away from the wallboard to pull the inner wallboard support against the interior surface of the wallboard to force the inner wallboard support to a fully opened position flush against the interior surface of the wallboard.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A wallboard removal tool comprising:

a shaft extending between an inner end at a front of the shaft and an outer end at a rear of the shaft;

an outer wallboard support coupled to the shaft, the outer wallboard support including a forward facing engagement surface configured to engage an exterior surface of a wallboard on a wall, the outer wallboard support and the shaft being movable relative to each other, the outer wallboard support located rearward of the inner end of the shaft, the outer wallboard support is slidably coupled to the shaft and movable between an advanced position and a retracted position, the outer wallboard support engaging the wallboard in the advanced position;

an inner wallboard support movably coupled to the shaft, the inner wallboard support including a rearward facing engagement surface configured to engage an interior surface of the wallboard on the wall, the rearward facing engagement surface located forward of the forward facing engagement surface of the outer wallboard support, the inner wallboard support being provided at the inner end; and an actuator operably coupled to the inner wallboard support, the actuator causing the inner wallboard support to move from a closed position to an opened position after the inner wallboard support is positioned behind the wallboard on the wall;

wherein the outer wallboard support is configured to engage the exterior surface of the wallboard to capture the wallboard between the inner wallboard support and the outer wallboard support;

wherein the actuator is accessible from the exterior of the wallboard to move the inner wallboard support; and wherein the wallboard removal tool is shaken to free the wallboard from fasteners holding the wallboard to studs of the wall.

2. A wallboard removal tool comprising:

a shaft extending between an inner end at a front of the shaft and an outer end at a rear of the shaft;

an outer wallboard support coupled to the shaft, the outer wallboard support including a forward facing engagement surface configured to engage an exterior surface of a wallboard on a wall, the outer wallboard support and the shaft being movable relative to each other, the outer wallboard support located rearward of the inner end of the shaft, the outer wallboard support includes a sleeve and a support plate extending outward from the sleeve, the sleeve being slidably coupled to the shaft;

an inner wallboard support movably coupled to the shaft, the inner wallboard support including a rearward facing engagement surface configured to engage an interior surface of the wallboard on the wall, the rearward facing engagement surface located forward of the forward facing engagement surface of the outer wallboard support, the inner wallboard support being provided at the inner end; and an actuator operably coupled to the inner wallboard support, the actuator causing the inner wallboard support to move from a closed position to an opened position after the inner wallboard support is positioned behind the wallboard on the wall;

wherein the outer wallboard support is configured to engage the exterior surface of the wallboard to capture the wallboard between the inner wallboard support and the outer wallboard support;

wherein the actuator is accessible from the exterior of the wallboard to move the inner wallboard support; and wherein the wallboard removal tool is shaken to free the wallboard from fasteners holding the wallboard to studs of the wall.

3. The wallboard removal tool of claim 1, wherein the inner wallboard support is rotatably coupled to the shaft, the inner wallboard support rotating between the closed position and the opened position, the inner wallboard support having a larger outer circumference in the opened position than the closed position.

4. The wallboard removal tool of claim 1, wherein the inner wallboard support includes a plurality of support arms rotatably coupled to the inner end of the shaft, the support arms being opened after the inner wallboard support is positioned behind the interior surface of the wallboard.

5. A wallboard removal tool comprising:

a shaft extending between an inner end and an outer end;

an outer wallboard support coupled to the shaft, the outer wallboard support and the shaft being movable relative to each other;

an inner wallboard support movably coupled to the shaft, the inner wallboard support being provided at the inner end, the inner wallboard support including a plurality of support arms rotatably coupled to the inner end of the shaft; and an actuator operably coupled to the inner wallboard support, the actuator causing the inner wallboard support to move from a closed position to an opened position after the inner wallboard support is positioned behind a wallboard on a wall;

wherein the inner wallboard support is configured to engage an interior surface of the wallboard, the support arms being opened after the inner wallboard support is positioned behind the interior surface of the wallboard, wherein the support arms lay flat against the shaft in closed positions and are rotated to opened positions to increase a surface area of the inner wallboard support;

wherein the outer wallboard support is configured to engage an exterior surface of the wallboard to capture the wallboard therebetween;

wherein the actuator is accessible from the exterior of the wallboard to move the inner wallboard support; and wherein the wallboard removal tool is shaken to free the wallboard from fasteners holding the wallboard to studs of the wall.

6. The wallboard removal tool of claim 4, wherein the support arms are elongated between attachment ends and free ends, the support arms being rotated about the attachment ends to move the free ends away from the shaft.

7. The wallboard removal tool of claim 4, wherein each support arm includes an interior side and an exterior side extending between an attachment end and a free end, the interior side being generally parallel to and facing the shaft in the closed position, the interior side being generally perpendicular to the shaft and facing the interior surface of the wallboard in the opened position.

8. The wallboard removal tool of claim 4, wherein the shaft includes four sides, the plurality of support arms includes four support arms each associated with and extending from a corresponding side of the shaft.

9. The wallboard removal tool of claim 1, wherein the actuator extends through an interior of the shaft to operably couple to the inner wallboard support, the actuator being movable relative to the shaft to move the inner wallboard support from the closed position to the opened position and to move the inner wallboard support from the opened position to the closed position.

10. The wallboard removal tool of claim 1, wherein the actuator extends from the inner end to the outer end and is coupled to the inner wallboard support at the inner end.

11. The wallboard removal tool of claim 1, further comprising a handle at the outer end of the shaft, the handle being shaken to free the wallboard from the fasteners holding the wallboard to the sides of the wall.

12. The wallboard removal tool of claim 1, further comprising a locking feature to lock a position of the outer wallboard support with respect to the shaft.

13. The wallboard removal tool of claim 12, wherein the locking feature is positioned to lock the outer wallboard support at approximately half inch from the inner wallboard support to fit half-inch wallboard therebetween.

14. A wallboard removal tool comprising:

a shaft extending between an inner end at a front of the shaft and an outer end at a rear of the shaft;

an outer wallboard support coupled to the shaft, the outer wallboard support including a forward facing engagement surface configured to engage an exterior surface of a wallboard on a wall, the outer wallboard support and the shaft being movable relative to each other, the outer wallboard support located rearward of the inner end of the shaft;

an inner wallboard support movably coupled to the shaft, the inner wallboard support including a rearward facing engagement surface configured to engage an interior surface of the wallboard on the wall, the rearward facing engagement surface located forward of the forward facing engagement surface of the outer wallboard support, the inner wallboard support being provided at the inner end, the inner wallboard support is configured to pass through an opening in the wallboard, the inner wallboard support being actuated to a partially opened position behind the wallboard such that the inner wallboard support is larger than the opening such that the inner wallboard support is unable to be pulled back through the opening; and an actuator operably coupled to the inner wallboard support, the actuator causing the inner wallboard support to move from a closed position to an opened position after the inner wallboard support is positioned behind the wallboard on the wall;

wherein the outer wallboard support is configured to engage the exterior surface of the wallboard to capture the wallboard between the inner wallboard support and the outer wallboard support;

wherein the actuator is accessible from the exterior of the wallboard to move the inner wallboard support; and wherein the wallboard removal tool is shaken to free the wallboard from fasteners holding the wallboard to studs of the wall;

wherein the shaft is pulled away from the wallboard to pull the inner wallboard support against the interior surface of the wallboard to force the inner wallboard support to a fully opened position flush against the interior surface of the wallboard.

15. The wallboard removal tool of claim 1, wherein the inner wallboard support has a first height and a first width in the closed position and the inner wallboard support has a second height and a second width in the opened position, the second height being at least three times the first height, the second width being at least three times the first width, wherein the outer wallboard support includes a support plate having a front surface configured to press against the exterior surface of the wallboard, the support plate having a third height and a third width approximately equal to the second height and the second width, respectively.

16. A wallboard removal tool comprising:

a shaft extending between an inner end and an outer end, the shaft being smooth;

an outer wallboard support having a sleeve and a support plate extending radially outward from the sleeve, the sleeve being freely slidably coupled to the smooth shaft; and an inner wallboard support including a plurality of support arms rotatably coupled to the shaft at the inner end, the support arms being movable between closed positions and opened positions, the support arms being folded close to the shaft in the closed positions, the support arms being splayed outward away from the shaft in the opened positions;

wherein the inner end and the inner wallboard support is configured to pass through an opening in a wallboard of a wall when the support arms are in the closed positions and wherein the support arms are configured to be moved to the opened positions behind the wallboard to engage an interior surface of the wallboard; and wherein the outer wallboard support is advanced toward the inner wallboard support to engage an exterior surface of the wallboard to capture the wallboard therebetween, the wallboard removal tool being shaken to free the wallboard from fasteners holding the wallboard to studs of the wall.

17. The wallboard removal tool of claim 16, wherein the shaft is rectangular and the sleeve is rectangular to prevent rotation of the sleeve relative to the shaft.

18. The wallboard removal tool of claim 16, further comprising an actuator operably coupled to the inner wallboard support, the actuator causing the inner wallboard support to move from the closed position to the opened position after the inner wallboard support is positioned behind the wallboard, wherein the actuator is accessible from the exterior of the wallboard to move the inner wallboard support.

19. A wallboard removal tool comprising:

a shaft extending between an inner end at a front of the shaft and an outer end at a rear of the shaft;

an outer wallboard support coupled to the shaft, the outer wallboard support including a forward facing engagement surface configured to engage an exterior surface of a wallboard on a wall, the outer wallboard support and the shaft being movable relative to each other, the outer wallboard support located rearward of the inner end of the shaft;

an inner wallboard support movably coupled to the shaft, the inner wallboard support including a rearward facing engagement surface configured to engage an interior surface of the wallboard on the wall, the rearward facing engagement surface located forward of the forward facing engagement surface of the outer wallboard support, the inner wallboard support being provided at the inner end; and an actuator operably coupled to the inner wallboard support, the actuator causing the inner wallboard support to move from a closed position to an opened position after the inner wallboard support is positioned behind the wallboard on the wall;

wherein the outer wallboard support is configured to engage the exterior surface of the wallboard to capture the wallboard between the inner wallboard support and the outer wallboard support;

wherein the actuator is accessible from the exterior of the wallboard to move the inner wallboard support; and wherein the shaft is smooth allowing the outer wallboard support to freely slide along the shaft;

wherein the wallboard removal tool is shaken to free the wallboard from fasteners holding the wallboard to studs of the wall.

20. The wallboard removal tool of claim 1, wherein the shaft is rectangular to prevent rotation of the outer wallboard support relative to the shaft.

21. The wallboard removal tool of claim 16, wherein the support plate has an engagement surface configured to engage the exterior surface of the wallboard, the engagement surface having a surface area larger than the opening.

22. The wallboard removal tool of claim 16, wherein each support arm includes an interior side and an exterior side extending between an attachment end and a free end, the interior side being generally parallel to and facing the shaft in the closed position, the interior side being generally perpendicular to the shaft and facing the interior surface of the wallboard in the opened position.

23. The wallboard removal tool of claim 16, wherein the shaft includes four sides, the plurality of support arms includes four support arms each associated with and extending from a corresponding side of the shaft.

24. The wallboard removal tool of claim 2, wherein the outer wallboard support is slidably coupled to the shaft and movable between an advanced position and a retracted position, the outer wallboard support engaging the wallboard in the advanced position.

25. The wallboard removal tool of claim 2, wherein the inner wallboard support includes a plurality of support arms rotatably coupled to the inner end of the shaft, the support arms being opened after the inner wallboard support is positioned behind the interior surface of the wallboard, the support arms lay flat against the shaft in closed positions and are rotated to opened positions to increase a surface area of the inner wallboard support.

26. The wallboard removal tool of claim 2, wherein the inner wallboard support is configured to pass through an opening in the wallboard, the inner wallboard support being actuated to a partially opened position behind the wallboard such that the inner wallboard support is larger than the opening such that the inner wallboard support is unable to be pulled back through the opening, the shaft being pulled away from the wallboard to pull the inner wallboard support against the interior surface of the wallboard to force the inner wallboard support to a fully opened position flush against the interior surface of the wallboard.

27. The wallboard removal tool of claim 2, wherein the inner wallboard support has a first height and a first width in the closed position and the inner wallboard support has a second height and a second width in the opened position, the second height being at least three times the first height, the second width being at least three times the first width, wherein the outer wallboard support includes a support plate having a front surface configured to press against the exterior surface of the wallboard, the support plate having a third height and a third width approximately equal to the second height and the second width, respectively.

28. The wallboard removal tool of claim 2, wherein the shaft is smooth allowing the outer wallboard support to freely slide along the shaft.

29. The wallboard removal tool of claim 2, wherein the shaft is rectangular to prevent rotation of the outer wallboard support relative to the shaft.

30. The wallboard removal tool of claim 14, wherein the outer wallboard support is slidably coupled to the shaft and movable between an advanced position and a retracted position, the outer wallboard support engaging the wallboard in the advanced position.

31. The wallboard removal tool of claim 14, wherein the outer wallboard support includes a sleeve and a support plate extending outward from the sleeve, the sleeve being slidably coupled to the shaft.

32. The wallboard removal tool of claim 14, wherein the inner wallboard support includes a plurality of support arms rotatably coupled to the inner end of the shaft, the support arms being opened after the inner wallboard support is positioned behind the interior surface of the wallboard, the support arms lay flat against the shaft in closed positions and are rotated to opened positions to increase a surface area of the inner wallboard support.

33. The wallboard removal tool of claim 14, wherein the inner wallboard support has a first height and a first width in the closed position and the inner wallboard support has a second height and a second width in the opened position, the second height being at least three times the first height, the second width being at least three times the first width, wherein the outer wallboard support includes a support plate having a front surface configured to press against the exterior surface of the wallboard, the support plate having a third height and a third width approximately equal to the second height and the second width, respectively.

34. The wallboard removal tool of claim 14, wherein the shaft is smooth allowing the outer wallboard support to freely slide along the shaft.

35. The wallboard removal tool of claim 14, wherein the shaft is rectangular to prevent rotation of the outer wallboard support relative to the shaft.

36. The wallboard removal tool of claim 19, wherein the outer wallboard support is slidably coupled to the shaft and movable between an advanced position and a retracted position, the outer wallboard support engaging the wallboard in the advanced position.

37. The wallboard removal tool of claim 19, wherein the outer wallboard support includes a sleeve and a support plate extending outward from the sleeve, the sleeve being slidably coupled to the shaft.

38. The wallboard removal tool of claim 19, wherein the inner wallboard support includes a plurality of support arms rotatably coupled to the inner end of the shaft, the support arms being opened after the inner wallboard support is positioned behind the interior surface of the wallboard, the support arms lay flat against the shaft in closed positions and are rotated to opened positions to increase a surface area of the inner wallboard support.

39. The wallboard removal tool of claim 19, wherein the inner wallboard support has a first height and a first width in the closed position and the inner wallboard support has a second height and a second width in the opened position, the second height being at least three times the first height, the second width being at least three times the first width, wherein the outer wallboard support includes a support plate having a front surface configured to press against the exterior surface of the wallboard, the support plate having a third height and a third width approximately equal to the second height and the second width, respectively.

40. The wallboard removal tool of claim 19, wherein the inner wallboard support is configured to pass through an opening in the wallboard, the inner wallboard support being actuated to a partially opened position behind the wallboard such that the inner wallboard support is larger than the opening such that the inner wallboard support is unable to be pulled back through the opening, the shaft being pulled away from the wallboard to pull the inner wallboard support against the interior surface of the wallboard to force the inner wallboard support to a fully opened position flush against the interior surface of the wallboard.

41. The wallboard removal tool of claim 19, wherein the shaft is rectangular to prevent rotation of the outer wallboard support relative to the shaft.

42. The wallboard removal tool of claim 5, wherein the support arms are elongated between attachment ends and free ends, the support arms being rotated about the attachment ends to move the free ends away from the shaft.

43. The wallboard removal tool of claim 5, wherein each support arm includes an interior side and an exterior side extending between an attachment end and a free end, the interior side being generally parallel to and facing the shaft in the closed position, the interior side being generally perpendicular to the shaft and facing the interior surface of the wallboard in the opened position.

44. The wallboard removal tool of claim 5, wherein the shaft includes four sides, the plurality of support arms includes four support arms each associated with and extending from a corresponding side of the shaft.

* * * * *